US011346300B2

(12) United States Patent
Kim

(10) Patent No.: US 11,346,300 B2
(45) Date of Patent: May 31, 2022

(54) METHOD AND DEVICE FOR LEARNING OPENING TIME OF INJECTOR FOR VEHICLE ENGINE

(71) Applicants: Hyundai Motor Company, Seoul (KR); Kia Motors Corporation, Seoul (KR)

(72) Inventor: Yong Sik Kim, Whasung-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 277 days.

(21) Appl. No.: 16/694,709

(22) Filed: Nov. 25, 2019

(65) Prior Publication Data

US 2021/0047979 A1 Feb. 18, 2021

(30) Foreign Application Priority Data

Aug. 12, 2019 (KR) ..... 10-2019-0098095

(51) Int. Cl.
*F02D 41/24* (2006.01)
*F02D 41/38* (2006.01)
*F02D 41/20* (2006.01)

(52) U.S. Cl.
CPC ..... *F02D 41/3863* (2013.01); *F02D 41/2441* (2013.01); *F02D 41/2467* (2013.01); *F02D 2041/2055* (2013.01)

(58) Field of Classification Search
CPC ..... F02D 41/20; F02D 41/40; F02D 41/221; F02D 41/247; F02D 41/401; F02D 41/403; F02D 41/2055; F02D 41/2406; F02D 41/2441; F02D 41/2438; F02D 41/2467; F02D 41/2496; F02D 41/3005; F02D 41/3809; F02D 41/3836; F02D 41/3863; F02D 2041/225; F02D 2041/1432; F02D 2200/0602; F02D 2200/0618; F02M 55/025; Y02T 10/44
USPC ..... 123/495, 478, 456, 447
See application file for complete search history.

(56) References Cited

U.S. PATENT DOCUMENTS

| | | | | |
|---|---|---|---|---|
| 5,535,621 | A | 7/1996 | Glidewell et al. | |
| 6,227,168 | B1 * | 5/2001 | Nishiyama | F02D 41/401 123/456 |
| 6,250,285 | B1 * | 6/2001 | Takase | F02D 41/221 123/456 |
| 6,755,176 | B2 * | 6/2004 | Takeuchi | F02D 41/402 123/299 |

(Continued)

FOREIGN PATENT DOCUMENTS

| | | |
|---|---|---|
| JP | H 10-47137 A | 2/1998 |
| KR | 10-2016-0130277 A | 11/2016 |
| WO | WO 2015/132074 A1 | 9/2015 |

*Primary Examiner* — Phutthiwat Wongwian
*Assistant Examiner* — Arnold Castro
(74) *Attorney, Agent, or Firm* — Morgan, Lewis & Bockius LLP

(57) ABSTRACT

A method for learning an opening time of an injector for an engine of a vehicle may include applying, by a controller, an injection start command to the injector supplying fuel to the engine; determining, by the controller, a fuel pressure change amount in a fuel rail supplying the fuel to the injector after the injection start command is applied; and learning, by the controller, an opening delay time of the injector based on the determined fuel pressure change amount.

16 Claims, 5 Drawing Sheets

(56) References Cited

U.S. PATENT DOCUMENTS

| | | | | |
|---|---|---|---|---|
| 7,657,361 | B2 * | 2/2010 | Inoue | F02D 41/1498 701/104 |
| 7,806,106 | B2 * | 10/2010 | Cinpinski | F02D 41/3854 123/446 |
| 7,980,120 | B2 * | 7/2011 | Cinpinski | F02M 63/022 73/114.43 |
| 8,893,685 | B2 | 11/2014 | Melis et al. | |
| 9,593,637 | B2 * | 3/2017 | Surnilla | F02D 19/0628 |
| 9,903,306 | B2 * | 2/2018 | Carey | F02M 65/001 |
| 2001/0032619 | A1 * | 10/2001 | Nishiyama | F02D 41/401 123/456 |
| 2009/0063016 | A1 * | 3/2009 | Nakata | F02D 41/2096 701/103 |
| 2012/0042853 | A1 * | 2/2012 | Sakata | F02D 41/2464 123/447 |
| 2012/0144907 | A1 * | 6/2012 | Komatsu | F02D 41/40 73/114.51 |
| 2013/0325301 | A1 * | 12/2013 | Gautier | F02D 41/402 701/104 |
| 2017/0074203 | A1 * | 3/2017 | Kober | F02M 57/005 |
| 2018/0010545 | A1 * | 1/2018 | Mukaihara | F02D 41/221 |
| 2018/0171924 | A1 * | 6/2018 | Oh | F02D 41/3094 |
| 2018/0306134 | A1 * | 10/2018 | Uhrich | F02P 9/002 |
| 2018/0306138 | A1 * | 10/2018 | Tanaka | F02D 41/402 |
| 2018/0328307 | A1 * | 11/2018 | Kurtz | F02D 41/008 |
| 2020/0291885 | A1 * | 9/2020 | Pursifull | F02D 41/38 |
| 2020/0291886 | A1 * | 9/2020 | Pursifull | F02M 65/003 |
| 2021/0017928 | A1 * | 1/2021 | Thomas | F02D 41/2451 |

* cited by examiner

METHOD AND DEVICE FOR LEARNING OPENING TIME OF INJECTOR FOR VEHICLE ENGINE

CROSS-REFERENCE TO RELATED APPLICATION

The present application claims priority to Korean Patent Application No. 10-2019-0098095 filed on Aug. 12, 2019, the entire contents of which is incorporated herein for all purposes by this reference.

BACKGROUND OF THE INVENTION

Field of the Invention

The present invention relates to a vehicle including an injector for an engine, and more particularly, to a method and a device for learning an opening time of an injector for a vehicle engine.

Description of Related Art

A fuel supply amount is determined by a controller which is an electronic control Unit (ECU) when supplying fuel to an engine of a vehicle, and the fuel is supplied into the engine by injecting the determined fuel amount into the engine using an injector.

The injector usually includes a solenoid, is provided for each cylinder of the engine to receive a fuel injection signal from the controller, and injects the fuel for a predetermined injection time to supply a required fuel amount to the engine.

A fuel injection method for the engine may be divided into a port injection method and a direct injection method. The port injection method is mainly used for a gasoline engine, and injects the fuel into an intake port to supply a mixture mixed with air into the cylinder of the engine. The direct injection method is mainly used for a diesel engine, and directly injects the fuel into the cylinder.

In recent years, a technique for adopting the direct injection method for the gasoline engine has been attracting attention to improve fuel efficiency and output of the engine and prevent environmental pollution. The engine using the direct injection method is called a gasoline direct injection (GDI) engine. In the GDI engine, air is drawn in from the intake port into a combustion chamber of the engine when an intake valve is open to be compressed by a piston and fuel is directly injected to a high pressure air introduced into the combustion chamber.

In the GDI engine, each injector is mounted for each cylinder of the engine to inject high pressure fuel. The solenoid valve of each the injector opens an injection outlet to inject fuel into the combustion chamber when the solenoid valve receives an injection command time or a drive signal from the controller, and closes the injection outlet when the injection end portions.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a method and a device configured for learning an opening time of an injector for an engine of a vehicle configured for accurately detecting the opening time of the injector using a fuel pressure in a fuel rail connected to the injector.

An exemplary embodiment of the present invention may provide the method for learning the opening time of the injector for the engine of the vehicle, including: applying, by a controller, an injection start command to the injector supplying fuel to the engine; determining, by the controller, a fuel pressure change amount in a fuel rail supplying the fuel to the injector after the injection start command is applied; and learning, by the controller, an opening delay time of the injector based on the determined fuel pressure change amount.

The fuel rail may include a high pressure fuel rail supplying fuel having a pressure higher than a predetermined pressure to the injector, and the high pressure of fuel may be compressed by a high pressure fuel pump of the vehicle.

The method for learning the opening time of the injector for the engine may further include: applying, by the controller, the injection start command to the injector in advance so that a fuel injection amount of the injector becomes a target fuel injection amount to compensate for the learned opening delay time of the injector.

The target fuel injection amount may be a fuel amount required when the injector injects a small fuel amount less than a reference fuel amount into a combustion chamber of the engine.

The determining the fuel pressure change amount may include: receiving, by the controller, an initial pressure signal of the fuel rail, which corresponds to a fuel pressure in the fuel rail which is generated before the injection start command is applied, from a pressure sensor; receiving, by the controller, a change pressure signal of the fuel rail, which corresponds to a fuel pressure in the fuel rail which is generated after the injection start command is applied, from the pressure sensor after the initial pressure signal of the fuel rail is received; and determining, by the controller, the fuel pressure change amount based on the initial pressure signal and the change pressure signal.

The controller may be configured to determine the fuel pressure change amount using a value obtained by subtracting the change pressure signal from the initial pressure signal.

The change pressure signal may be a signal that filters a fuel pressure signal in the fuel rail measured by the pressure sensor.

The change pressure signal may be generated due to a change in a volume of fuel in the fuel rail generated when a needle of the injector is moved.

The learning the opening delay time of the injector may include: determining, by the controller, whether the fuel pressure change amount exceeds a threshold value for determining opening of the injector; and storing, by the controller, the opening delay time of the injector corresponding to a minimum value of the fuel pressure change amount exceeding the threshold value in a memory when the fuel pressure change amount exceeds the threshold value.

The method for learning the opening time of the injector for the engine may further include: determining, by the controller, whether a time value of a timer measuring the opening time of the injector exceeds a learning time which is a time for learning the opening time of the injector and is a maximum time required for a fuel injection amount of the injector to become a target fuel injection amount for a specific operation method of the engine when the fuel pressure change amount does not exceed the threshold value; and determining, by the controller, that the opening time of the injector is bad and storing the determination value in the memory when the time value of the timer exceeds the learning time.

An exemplary embodiment of the present invention may provide the device configured for learning the opening time of the injector for the engine of the vehicle, including: the injector configured to supply fuel to the engine; and a controller configured to determine a fuel pressure change amount in a fuel rail supplying the fuel to the injector after the controller is configured to apply an injection start command to the injector. The controller may be configured to learn an opening delay time of the injector based on the determined fuel pressure change amount.

The fuel rail may include a high pressure fuel rail supplying fuel having a pressure higher than a predetermined pressure to the injector, and the high pressure of fuel may be compressed by a high pressure fuel pump of the vehicle.

The controller may be configured to apply the injection start command to the injector in advance so that a fuel injection amount of the injector becomes a target fuel injection amount to compensate for the learned opening delay time of the injector.

The target fuel injection amount may be a fuel amount required when the injector injects a small fuel amount less than a reference fuel amount into a combustion chamber of the engine.

The controller may be configured to receive an initial pressure signal of the fuel rail, which corresponds to a fuel pressure in the fuel rail which is generated before the injection start command is applied, from a pressure sensor. The controller may be configured to receive a change pressure signal of the fuel rail, which corresponds to a fuel pressure in the fuel rail which is generated after the injection start command is applied, from the pressure sensor after the initial pressure signal of the fuel rail is received. The controller may be configured to determine the fuel pressure change amount based on the initial pressure signal and the change pressure signal.

The controller may be configured to determine the fuel pressure change amount using a value obtained by subtracting the change pressure signal from the initial pressure signal.

The change pressure signal may be a signal that filters a fuel pressure signal in the fuel rail measured by the pressure sensor.

The change pressure signal may be generated due to a change in a volume of fuel in the fuel rail generated when a needle included in the injector is moved.

The controller may be configured to determine whether the fuel pressure change amount exceeds a threshold value for determining opening of the injector. The controller may be configured to determine the opening delay time of the injector corresponding to a minimum value of the fuel pressure change amount exceeding the threshold value using a timer when the fuel pressure change amount exceeds the threshold value. The controller may be configured to store the determined opening delay time in a memory.

The controller may be configured to determine whether a time value of the timer measuring the opening time of the injector exceeds a learning time which is a time for learning the opening time of the injector and is a maximum time required for a fuel injection amount of the injector to become a target fuel injection amount for a specific operation method of the engine when the fuel pressure change amount does not exceed the threshold value. The controller may be configured to determine that the opening time of the injector is bad and to store the determination value in the memory when the time value of the timer exceeds the learning time.

The method and the device configured for learning the opening time of the injector for the engine of the vehicle according to the exemplary embodiment of the present invention may precisely control a fuel amount in an operating region of the injector (e.g., a low flow quantity region of the injector) by accurately determining the opening time of the injector using the fuel pressure of the fuel rail (e.g., a high pressure fuel rail) connected to the injector.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
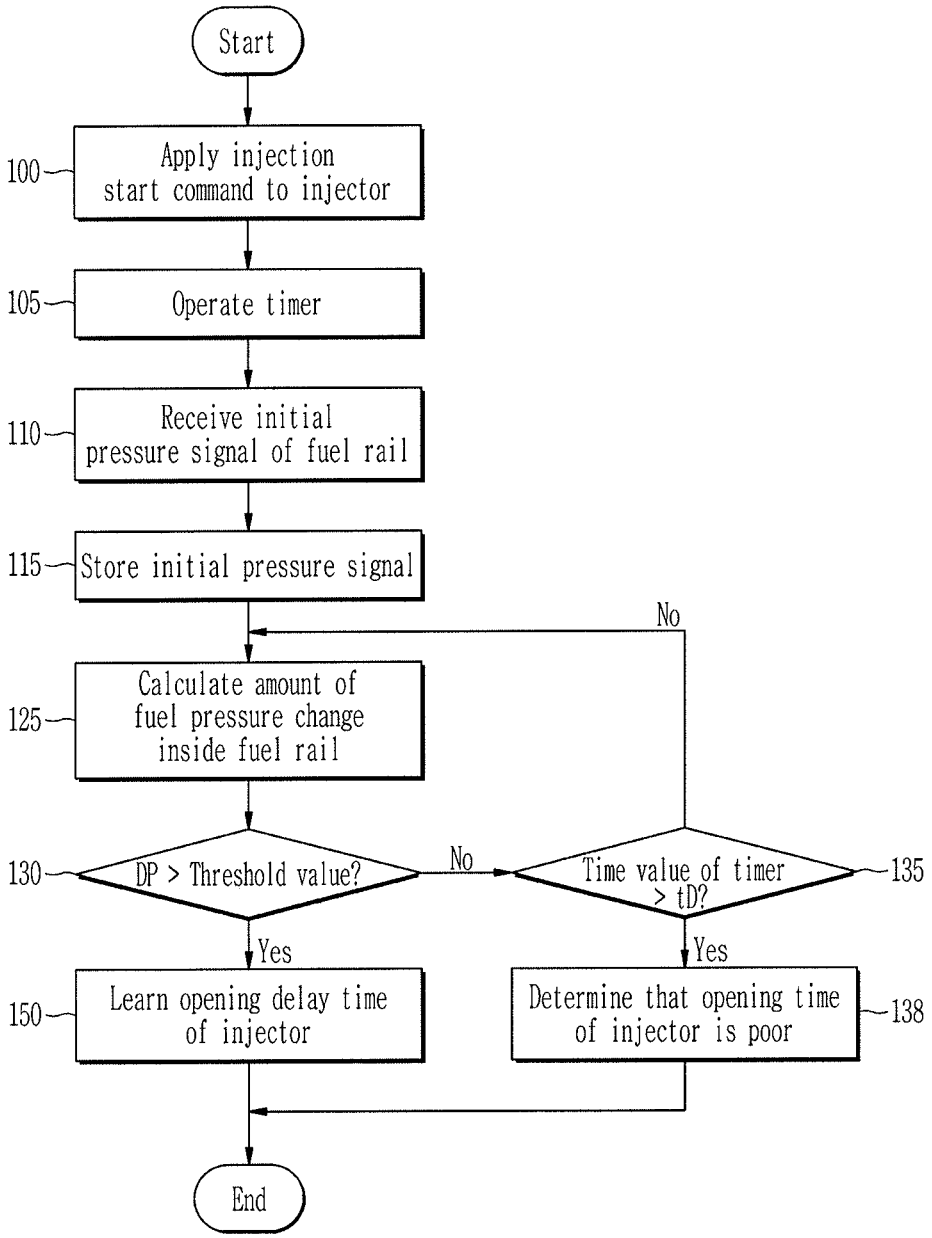
FIG. 1 is a flowchart illustrating a method for learning an opening time of an injector for an engine according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other h, and the present invention(s) is/are intended to cover not only the exemplary embodiments of the present invention, but also various alternatives, modifications, equivalents and other embodiments, which may be included within the spirit and scope of the present invention as defined by the appended claims.

To sufficiently understand the present invention and the object achieved by embodying the present invention, the accompanying drawings illustrating exemplary embodiments of the present invention and contents described in the accompanying drawings are to be referenced.

Hereinafter, the present invention will be described in detail by describing exemplary embodiments of the present invention with reference to the accompanying drawings. In describing the present invention, well-known configurations or functions will not be described in detail since they may unnecessarily obscure the gist of the present invention. Throughout the accompanying drawings, the same reference numerals will be used to denote the same components.

Terms used in the exemplary embodiment are only used to describe specific exemplary embodiments rather than limiting the present invention. Singular forms are to include plural forms unless the context clearly indicates otherwise. It will be further understood that the terms "include" or "have" used in the exemplary embodiment specify the presence of features, numerals, steps, operations, components, or parts mentioned in the exemplary embodiment, or a combination thereof, but do not preclude the presence or addition of one or more other features, numerals, steps, operations, components, parts, or a combination thereof.

Throughout the present specification and the claims that follow, when it is described that an element is "coupled" to another element, the element may be "directly coupled" to the other element or "electrically or mechanically coupled" to the other element through a third element.

Unless defined otherwise, it is to be understood that the terms used in the exemplary embodiment including technical and scientific terms have the same meanings as those that are understood by those skilled in the art. It may be understood that the terms defined by the dictionary are identical with the meanings within the context of the related art, and they may not be ideally or excessively formally defined unless the context clearly dictates otherwise.

According to a related art, in a low flow rate region in which an injector has a small flow quantity (or an injection amount), a misfire of an engine included in a vehicle may be generated due to a flow deviation (or a flow error) of the injector or a torque deviation of the engine may cause a roughness value (i.e., a rotation speed value of a crankshaft of the engine) of the engine to deteriorate. A factor causing the flow deviation may include a deviation of an opening time or a closing time of the injector due to a deviation of the injector product or an individual characteristic of the injector.

Figure 2:
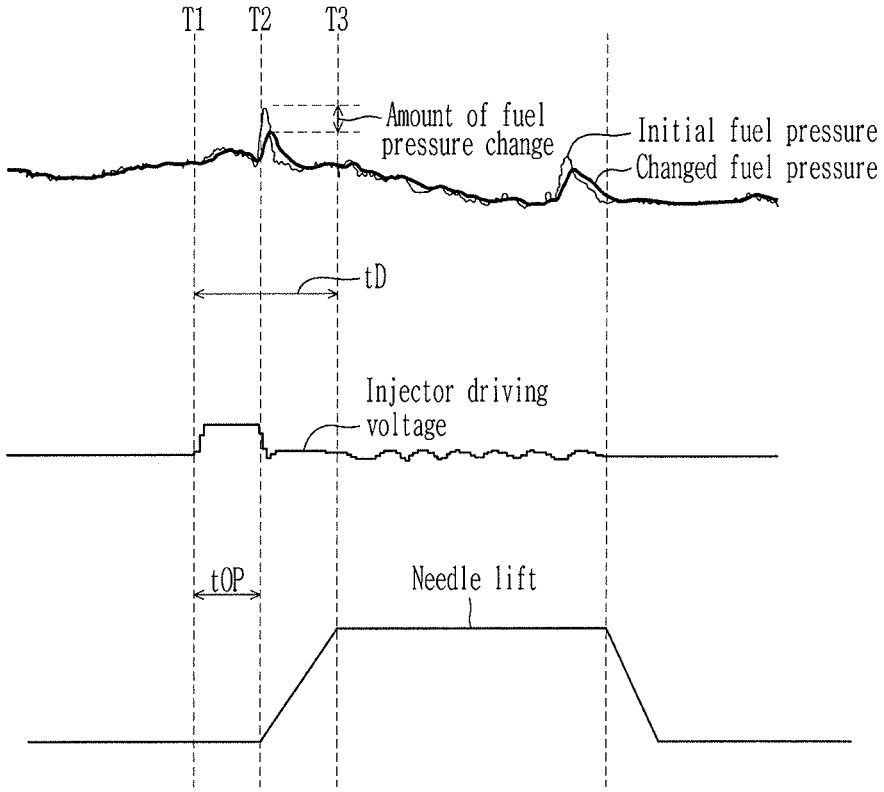
FIG. 2 is a timing diagram explaining the method for learning the opening time of the injector for the engine shown in FIG. 1.
Figure 3:
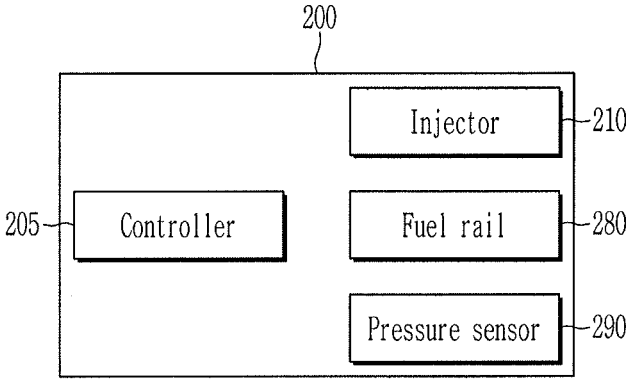
FIG. 3 is a block diagram illustrating a device configured for learning an opening time of the injector for the engine according to an exemplary embodiment of the present invention.
Figure 4:
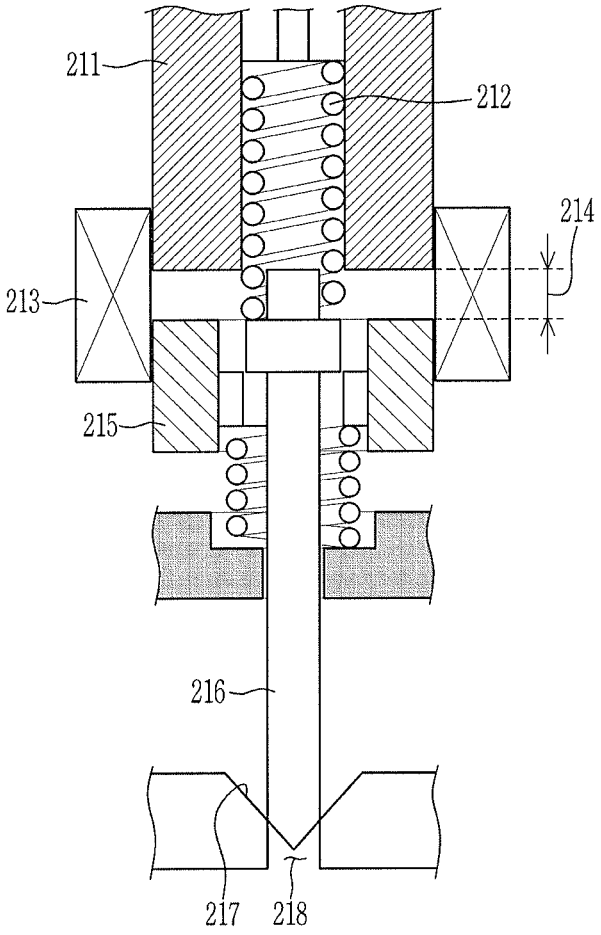
FIG. 4 is a view explaining an exemplary operation of the injector shown in FIG. 3.
Figure 5:
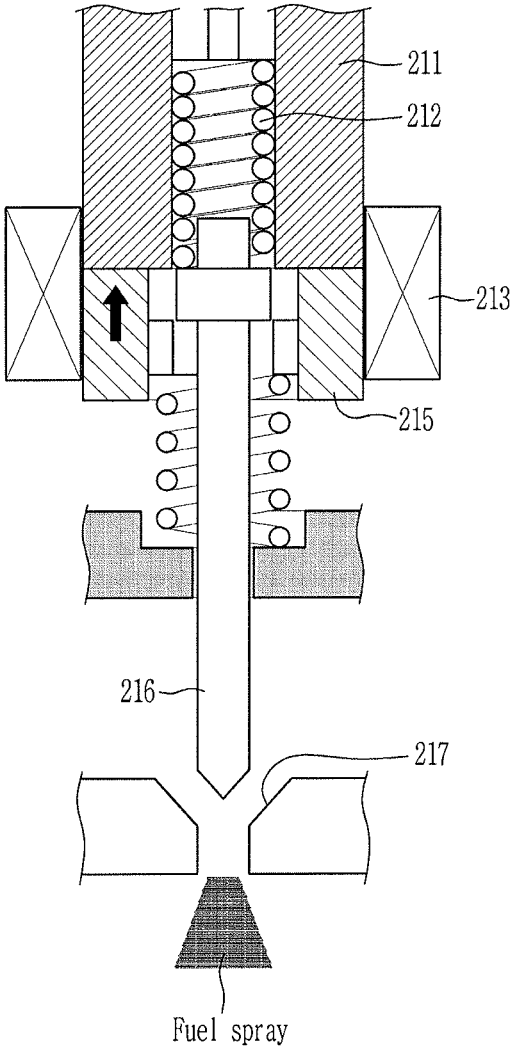
FIG. 5 is a view explaining another exemplary operation of the injector shown in FIG. 3.

FIG. 1 is a flowchart illustrating a method for learning an opening time of an injector for an engine according to an exemplary embodiment of the present invention. FIG. 2 is a timing diagram explaining the method for learning the opening time of the injector for the engine shown in FIG. 1. FIG. 3 is a block diagram illustrating a device configured for learning an opening time of the injector for the engine according to an exemplary embodiment of the present invention. FIG. 4 is a view explaining an exemplary operation of the injector shown in FIG. 3. FIG. 5 is a view explaining another exemplary operation of the injector shown in FIG. 3.

Referring to FIG. 1 through FIG. 5, in a determination step 100, a controller 205 may apply an injection start command or a drive command to the injector 210, which supplies fuel to the engine of a vehicle, at a first time T1 of FIG. 2. The injection start command may correspond to a voltage driving the injector 210 shown in FIG. 2.

The controller 205 may be an electronic control unit (ECU) and may control an entire operation of the vehicle including the device 200 for learning the opening time of the injector for the engine. For example, the controller 205 may be one or more microprocessors operated by a program or hardware (e.g., a microcomputer) including the microprocessor. The program may include a series of commands for executing the method for learning the opening time of the injector for the engine according to the exemplary embodiment of the present invention. The commands may be stored in a memory of the device 200 for learning the opening time of the injector for the engine.

As shown in FIG. 3, the device 200 for learning the opening time of the injector may include the controller 205, the injector 210, a fuel rail 280 connected to the injector, and a pressure sensor 290 for measuring or detecting a fuel pressure inside the fuel rail.

The injector 210 may be, for example, a gasoline direct injection (GDI) injector, and may supply fuel to a combustion chamber of the engine. As shown in FIG. 4, the injector 210 may include a needle or a needle valve 216 that opens and closes an injection outlet 218 and is mounted or positioned on a valve seat 217, an armature 215 which is combined with the needle to linearly move the needle, a magnetic member or a magnetic core 211 mounted above the armature, a solenoid coil 213 forming a solenoid magnetic field, and a return spring 212 returning the moved needle and the armature. The solenoid coil 213 may be electrically connected to the controller 205 to receive a driving signal which is a control signal.

Referring to FIG. 5, when the driving signal is applied to the solenoid coil 213, an electromagnetic field may be formed in the magnetic member 211. The electromagnetic field may generate an attraction force so that the armature 215 moves as much as a lift amount 214 of the needle 216. The armature 215 may move the needle 216 so that the injection outlet 218 is open.

For example, the fuel rail 280 may include a high pressure fuel rail. The high pressure fuel rail may supply high pressure of fuel to the injector 210. The high pressure of fuel may be compressed by a high pressure fuel pump of the vehicle and the high pressure may be a pressure greater than a reference pressure (e.g., 240 (bar)). The high pressure fuel pump may receive fuel from a fuel tank of the vehicle.

According to an operation step 105 shown in FIG. 1, the controller 205 may operate a timer for measuring or determining the opening time of the injector 210 at the first time T1. The timer may be disposed inside or outside the controller 205.

According to a step 110, the controller 205 may receive an initial pressure signal of the fuel rail 280, which corresponds to the fuel pressure inside the fuel rail which is generated before the injection start command is applied, from the pressure sensor 290.

According to a step 115, the controller 205 may store the initial pressure signal and an application time of the injection start command in the memory or a table of the device 200. A fuel injection time, an injection pressure, or a temperature model value of the injector 210 may be stored in the memory. The memory may be mounted inside or outside the controller 205.

According to a step 125, after the initial pressure signal of the fuel rail 280 is received, the controller 205 may receive a change pressure signal of the fuel rail 280, which corresponds to the fuel pressure inside the fuel rail which is generated after the injection start command is applied, from the pressure sensor 290. To detect a correct opening time of the injector 210, for example, the change pressure signal may be a signal that filters a fuel pressure signal inside the fuel rail 280 measured by the pressure sensor 290. The filtering may be performed by a low pass filter or a recursive filter (e.g., a recursion M filter). The change pressure signal may be generated due to a change in a volume of fuel inside the fuel rail 280 generated when the armature 215 and the needle 210 of the injector 210 are moved.

The controller 205 may determine an amount DP of fuel pressure change within the fuel rail 280 based on the initial pressure signal and the change pressure signal. For example, the controller 205 may determine the amount DP of fuel pressure change using a value obtained by subtracting the change pressure signal from the initial pressure signal.

According to a step 130, the controller 205 may determine whether the amount DP of fuel pressure change exceeds a threshold value. The threshold value may be a value for determining opening of the injector 210 and may be determined by a test or an experiment.

When the amount DP of fuel pressure change does not exceed the threshold value, the method for learning the opening time of the injector, which is a process, may proceed to a step 135. When the amount DP of fuel pressure change exceeds the threshold value, the process may proceed to a step 150.

According to the step 135, the controller 205 may determine whether a time value of the timer exceeds a learning time tD for learning or diagnosing the opening time of the injector 210. The learning time tD is a maximum time required for a fuel injection amount of the injector to become a target fuel injection amount for a specific operation method of the engine, and may be stored in the memory of the device 200. As shown in FIG. 2, the learning time tD may be a time between the first time T1 and a third time T3. For example, the target fuel injection amount may be a fuel amount required when the injector 210 injects a small fuel amount less than a reference fuel amount (e.g., 24 (mg/ms)) into the combustion chamber of the engine. A method in which the injectors inject a small fuel amount into the combustion chamber of the engine several times may be referred to as a multi-injection method.

When the time value of the timer does not exceed the learning time tD of the injector 210, the process may proceed to the step 125. When the time value of the timer exceeds the learning time tD, the process may proceed to a step 138.

According to the step 138, the controller 205 may determine that the opening time of the injector 210 is bad, and may store the determination value in the memory.

According to the step 150, the controller 205 may learn or detect an opening delay time tOP of the injector 210 corresponding to a minimum value of the amount DP of fuel pressure change exceeding the threshold value at a second time T2. In more detail, the controller 205 may determine the opening delay time tOP of the injector corresponding to the minimum value of the amount DP of fuel pressure change using the timer and may store the determined opening delay time in the memory.

When the learned opening delay time of the injector 210 is greater than a reference value that allows the fuel injection amount of the injector to become the target fuel injection amount, the controller 205 may increase the fuel injection time of the injector by applying the injection start command to the injector in advance so that the fuel injection amount of the injector becomes the target fuel injection amount to prevent a decrease in the fuel injection amount of the injector due to the learned opening delay time. When the learned opening delay time of the injector 210 is less than the reference value, the controller 205 may reduce the fuel injection time of the injector by delaying the injection start command for the injector so that the fuel injection amount of the injector becomes the target fuel injection amount to prevent an increase in the fuel injection amount of the injector due to the learned opening delay time.

The components, "~unit", block, or module which are used in the exemplary embodiment of the present invention may be implemented in software such as a task, a class, a subroutine, a process, an object, an execution thread, or a program which is performed in a predetermined region in the memory, or hardware such as a field programmable gate array (FPGA) or an application-specific integrated circuit (ASIC), and may be performed with a combination of the software and the hardware. The components, '~part', or the like may be embedded in a computer-readable storage medium, and some portion thereof may be dispersedly distributed in a plurality of computers.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A method of learning an opening time of an injector for an engine of a vehicle, the method comprising:

applying, by a controller, an injection start command to the injector supplying fuel to the engine;

determining, by the controller, a fuel pressure change amount in a fuel rail supplying the fuel to the injector after the injection start command is applied; and learning, by the controller, an opening delay time of the injector based on the determined fuel pressure change amount, wherein the determining the fuel pressure change amount includes:

receiving, by the controller, an initial pressure signal of the fuel rail, which corresponds to a fuel pressure in the fuel rail which is generated before the injection start command is applied, from a pressure sensor;

receiving, by the controller, a change pressure signal of the fuel rail, which corresponds to a fuel pressure in the fuel rail which is generated after the injection start command is applied, from the pressure sensor after the initial pressure signal of the fuel rail is received; and determining, by the controller, the fuel pressure change amount based on the initial pressure signal and the change pressure signal, and wherein the controller is configured to determine the fuel pressure change amount using a value obtained by subtracting the change pressure signal from the initial pressure signal.

2. The method of claim 1, wherein the fuel rail includes a high pressure fuel rail supplying fuel having a pressure higher than a predetermined pressure to the injector, and wherein the fuel is compressed to or more than the predetermined pressure by a fuel pump of the vehicle.

3. The method of claim 1, further including:

applying, by the controller, the injection start command to the injector in advance so that a fuel injection amount of the injector becomes a target fuel injection amount to compensate for the learned opening delay time of the injector.

4. The method of claim 3, wherein the target fuel injection amount is a fuel amount required when the injector injects a fuel amount less than a reference fuel amount into a combustion chamber of the engine.

5. The method of claim 1, wherein the change pressure signal is a signal that filters a fuel pressure signal in the fuel rail measured by the pressure sensor.

6. The method of claim 1, wherein the change pressure signal is generated due to a change in a volume of fuel in the fuel rail generated when a needle of the injector is moved.

7. The method of claim 1, wherein the learning the opening delay time of the injector includes:

determining, by the controller, whether the fuel pressure change amount exceeds a threshold value for determining opening of the injector; and storing, by the controller, the opening delay time of the injector corresponding to a minimum value of the fuel pressure change amount exceeding the threshold value in a memory upon determining that the fuel pressure change amount exceeds the threshold value.

8. The method of claim 7, further including:

determining, by the controller, whether a time value of a timer measuring the opening time of the injector exceeds a learning time which is a time for learning the opening time of the injector and is a maximum time required for a fuel injection amount of the injector to become a target fuel injection amount when the fuel pressure change amount does not exceed the threshold value; and determining, by the controller, that the opening time of the injector is bad and storing the determined time value in the memory upon determining that the time value of the timer exceeds the learning time.

9. A device of learning an opening time of an injector for an engine of a vehicle, the device comprising:

the injector configured to supply fuel to the engine; and a controller configured to determine a fuel pressure change amount in a fuel rail supplying the fuel to the injector after the controller is configured to apply an injection start command to the injector, wherein the controller is configured to learn an opening delay time of the injector based on the determined fuel pressure change amount, wherein the controller is configured to receive an initial pressure signal of the fuel rail, which corresponds to a fuel pressure in the fuel rail which is generated before the injection start command is applied, from a pressure sensor, wherein the controller is configured to receive a change pressure signal of the fuel rail, which corresponds to a fuel pressure in the fuel rail which is generated after the injection start command is applied, from the pressure sensor after the initial pressure signal of the fuel rail is received, wherein the controller is configured to determine the fuel pressure change amount based on the initial pressure signal and the change pressure signal, and wherein the controller is configured to determine the fuel pressure change amount using a value obtained by subtracting the change pressure signal from the initial pressure signal.

10. The device of claim 9, wherein the controller is configured to determine whether the fuel pressure change amount exceeds a threshold value for determining opening of the injector, wherein the controller is configured to determine the opening delay time of the injector corresponding to a minimum value of the fuel pressure change amount exceeding the threshold value using a timer upon determining that the fuel pressure change amount exceeds the threshold value, and wherein the controller is configured to store the determined opening delay time in a memory.

11. The device of claim 10, wherein the controller is configured to determine whether a time value of the timer measuring the opening time of the injector exceeds a learning time which is a time for learning the opening time of the injector and is a maximum time required for a fuel injection amount of the injector to become a target fuel injection amount upon determining that the fuel pressure change amount does not exceed the threshold value, and wherein the controller is configured to determine that the opening time of the injector is bad and to store the determined time value in the memory upon determining that the time value of the timer exceeds the learning time.

12. The device of claim 9, wherein the fuel rail includes a high pressure fuel rail supplying fuel having a pressure higher than a predetermined pressure to the injector, and wherein the fuel is compressed to or more than the predetermined pressure by a fuel pump of the vehicle.

13. The device of claim 9, wherein the controller is configured to apply the injection start command to the injector in advance so that a fuel injection amount of the injector becomes a target fuel injection amount to compensate for the learned opening delay time of the injector.

14. The device of claim 13, wherein the target fuel injection amount is a fuel amount required when the injector injects a fuel amount less than a reference fuel amount into a combustion chamber of the engine.

15. The device of claim 9, wherein the change pressure signal is a signal that filters a fuel pressure signal in the fuel rail measured by the pressure sensor.

16. The device of claim 9, wherein the change pressure signal is generated due to a change in a volume of fuel in the fuel rail generated when a needle included in the injector is moved.

* * * * *